US006177863B1

(12) United States Patent
Oliver, Jr.

(10) Patent No.: US 6,177,863 B1
(45) Date of Patent: Jan. 23, 2001

(54) AUDIO ALARM SIGNAL INITIATION DEVICE

(75) Inventor: Thomas S. Oliver, Jr., North Dartmouth, MA (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/228,081

(22) Filed: Dec. 28, 1998

(51) Int. Cl.[7] ..... G08B 3/00
(52) U.S. Cl. ..... 340/328; 340/384.71
(58) Field of Search ..... 340/328, 384.7, 340/384.71

(56) References Cited

U.S. PATENT DOCUMENTS 5,099,222 * 3/1992 Campagna ..... 340/475

* cited by examiner

*Primary Examiner*—Thomas J. Mullen, Jr.

(74) *Attorney, Agent, or Firm*—Michael J. MCGowan; Robert W. Gauthier; Prithvi C. Lall

(57) ABSTRACT

A device and method, which progressively and sequentially increases the volume of the alarm signal upon the initiation of the alarm, is provided. The disclosed device includes a multiple voltage-controlled oscillator, at least two dual-input positive-NAND gates, a shift register and a plurality of transistors and resistors, which are configured to sequentially include the resistors into the alarm circuit. The method includes sequentially and progressively increasing the volume of an initiated audio alarm signal by sequentially including one of the plurality of resistors into the alarm circuit to vary the volume of the alarm signal emanating from an alarm speaker. The resistors are included into the alarm circuit by sequentially switching on the corresponding one of the plurality of transistors. The transistors are switched on in response to outputs received from a shift register, which is shifted in response to an output received from a first NAND gate. Once the lowest value resistor is included into the alarm circuit, the alarm volume is maintained at its highest, unmodified level by providing the last output to become switched on of the shift register as an input to a second NAND gate and providing an output of the second NAND gate as a second input to the first NAND gate, thus causing the output of the first NAND gate to remain constant for the duration of the alarm signal.

11 Claims, 2 Drawing Sheets

AUDIO ALARM SIGNAL INITIATION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The disclosed invention relates to audio alarm signal devices. More specifically, the disclosed invention provides a device which gradually increases the volume of an audio alarm upon the initiation of the alarm.

(2) Description of the Prior Art

Almost everyone has experienced the startling effect of the initiation of an audio alarm, such as a fire alarm. Indeed, a startling effect is one feature of such alarms in that they are designed to immediately and convincingly warn of a dangerous or even life threatening condition. Audio alarms are also typically high volume alarms so that they can be readily heard above background noise. While these features of audible alarm signals are preferred in the majority of situations when a dangerous condition is to be signaled, there are times when a substantially instantaneous full volume audio alarm initiation is unwanted. For example, an individual who has a heart condition may not: want such a startling alarm initiation sequence for fear of creating undue stress. In addition, when precise operations are being performed, such as explosive material handling or a surgeon performing surgery, a full volume audio alarm signal initiation could have devastating or catastrophic consequences.

Examples of prior art alarm initiation circuits are shown in U.S. Pat. Nos.: 4,523,058; 4,219,799; 4,482,888; 4,237,448; 3,681,916; and 3,931,621. However, none of these prior art patents disclose the precise alarm initiation device taught by the instant application. For example, the '058 Patent (Stevens et al.) is not an automatic alarm device and does not appear to be designed with this feature in mind. Likewise, the '799 Patent (Weber) is not an automatic alarm device and can not produce more than two different sound intensity levels. The '888 Patent (Todaka et al.) does not produce different sound intensities upon alarm initiation but, rather, it varies the frequency of the waveform at the output. In fact, it appears to produce three different frequencies of sound, not four actual intensity levels as is taught by the instant invention. The '448 Patent (Weinberg) teaches a pager with an escalating audio alert signal level. However, this reference does not teach or suggest an alarm initiation device that can be easily reconfigured to vary alarm sound levels between soft and loud levels in any fashion, such as the device disclosed herein, which can be readily changed by simply changing the values of resistors within the device. The '916 Patent (Itoyama et al.) discloses an analog alarm initiation device, not a digital device such as the one disclosed by the instant invention. Accordingly, it suffers from the same limitation described above with respect to Weinberg, namely, it is limited to escalating alarm signals and cannot be reconfigured to allow for any initiation strategy. The '621 Patent (Rose) teaches a device similar to that disclosed in Yatomama et al., namely, an inflexible, analog alarm system.

Accordingly, an audio alarm signal initiation device is needed which could provide a gradual alarm initiation sequence.

SUMMARY OF THE INVENTION

The disclosed invention provides an audio alarm signal initiation device which progressively increases the volume of an audio alarm signal in discrete steps in a short, yet non-instantaneous time period. The disclosed device includes a multiple voltage-controlled oscillator, at least two dual-input positive-NAND gates, a shift register and a plurality of transistors and resistors. These components are configured into a circuit, which provides the disclosed audio alarm signal initiation device.

BRIEF DESCRIPTION OF THE DRAWINGS

These and other features and advantages of the present invention will be better understood in view of the following description of the invention taken together with the drawings wherein corresponding reference characters indicate corresponding parts throughout the several views of the drawings and wherein.

DESCRIPTION OF THE PREFERRED EMBODIMENT

Figure 1:
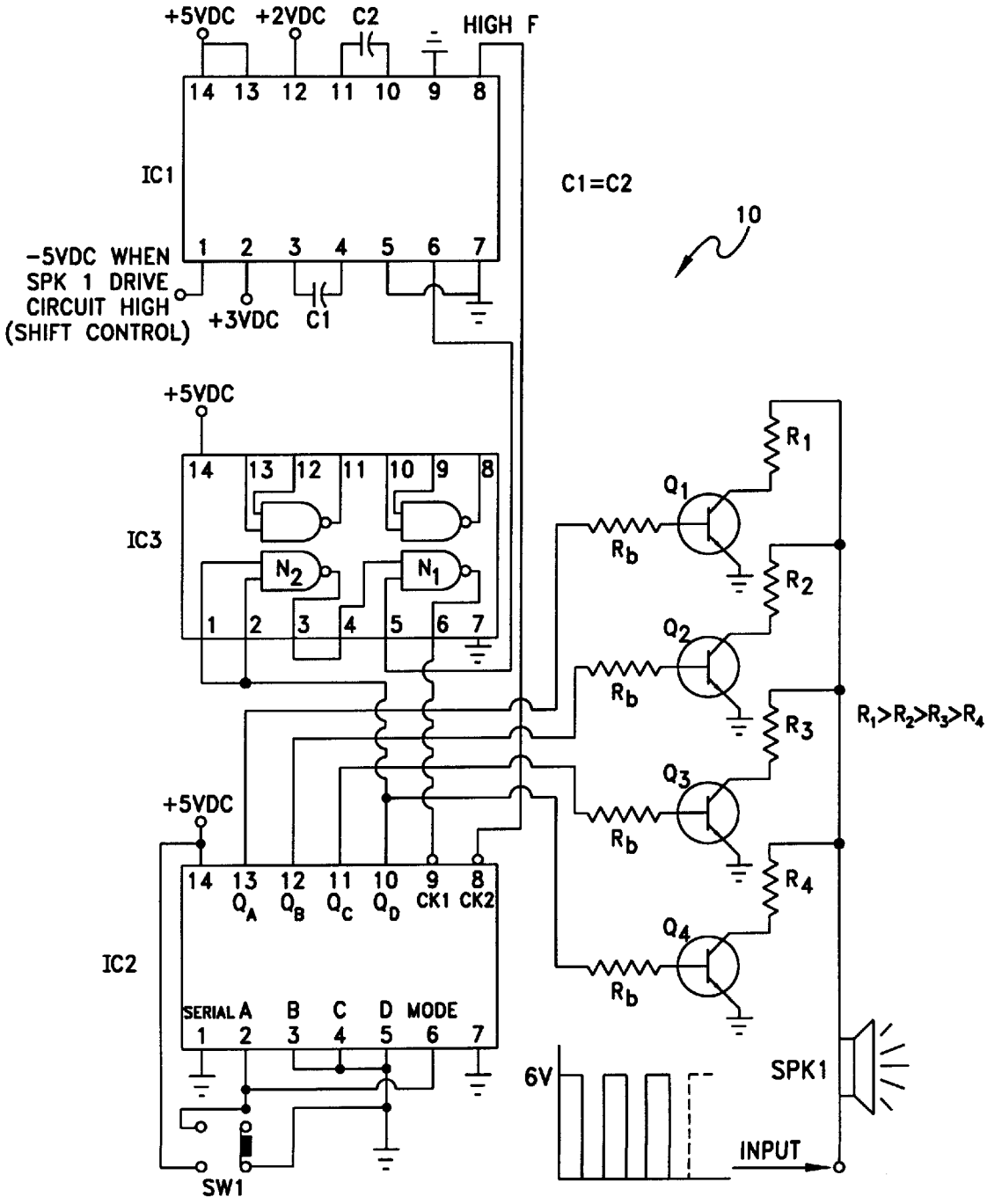
FIG. 1 is a circuit diagram showing the components of the disclosed invention.

Turning now to FIG. 1, the disclosed audio alarm signal initiation device 10 is shown. The device 10 includes two medium-scale integration (MSI) integrated circuits, IC1 and IC2, one small scale integration (SSI) integrated circuit, IC3, two capacitors, C1 and C2, four transistors, $Q_1$–$Q_4$, eight resistors, designated as $R_1$, $R_2$, $R_3$, $R_4$, and (4) $R_B$, and one switch, SW1.

The result of the circuit of FIG. 1 is the creation of a rapidly increasing audio output, which reaches a maximum unmodified audio output in about three seconds. The disclosed device is also readily resettable so that future alarm signals will exhibit the same rapidly increasing minimum to maximum audio behavior as any other alarm signal.

IC1 in FIG. 1, which in a preferred embodiment is a multiple voltage-controlled oscillator, such as a dual voltage-controlled oscillator (VCO), generates at least two identical five volt (5 V), fifty percent (50%) duty cycle square waves at pins 6 and 8. The square wave signal at pin 6 is generated only when pin 1 is driven to 5 V from the speaker drive circuit (not shown) when the alarm is to begin sounding. The other signal is always generated provided the indicated power levels exist at the indicated pins of IC1 (5VDC at pins 13 and 14, 2VDC at pin 12 and $\phi$VDC at pins 7 and 9). The capacitors included with IC1 between pins 3 and 4 and between pins 10 and 11 determine the frequency of the square wave output signals at pins 6 and 8 respectively. In the circuit of FIG. 1, C1 and C2 are 500 microFarad ($\mu$F)/5 V capacitors, which create a 1 Hz square wave.

The output signal at pin 6 of IC1 is provided to the input of a first NAND gate N1 at pin 5 of IC3. The output of this gate N1 at pin 6 of IC3 controls the "clocking" or action of IC2. IC2 is a 4 bit parallel-access shift register.

If the output signal at pin 6 of IC1, which is the input at pin 5 of IC3, ceases, then the output of NAND gate N1 on IC3 ceases to change. Consequently, the clock (CK1) on IC2 does not change. If this happens then the output of IC2 does not change and the speaker output remains at its current state (off, maximum, or somewhere in between, provided the square wave input exists at the speaker for the latter two).

The normal mode of operation of IC2 is shown in FIG. 1 with SW1 in the indicated position. When the square wave input comes in at pin 9 of IC2, the outputs $Q_B$ through $Q_D$ "shift" right so that $Q_B$ becomes the value of what $Q_A$ was before it was changed by the clock signal and provides a switch signal to transistor $Q_2$. $Q_C$ becomes $Q_B$, etc. Output $Q_A$ becomes $\phi$V. The full logic function table can be seen in Tables 1 and 2, below.

As the single 5 V output from IC2 at pins 10 to 13 moves from pin 13 to pin 10, a switch signal is provided to each of the transistors $Q_1$ through $Q_4$, in turn, and the respective transistor associated with the 5 V output is "switched on", while the other transistors associated with the pins having $\phi$V are "switched off". This allows current to flow in its collector circuit, i.e., through the speaker SPK1, through the resistor $R_1$, $R_2$, $R_3$ or $R_4$ as the case may be, through the transistor, and then to ground. Since $R_1>R_2>R_3>R_4$, the speaker volume will increase as the transistors $Q_1$ to $Q_4$ are "switched on." It is noted that resister $R_4$ may be eliminated from circuit 10, i.e., $R_4=0$, while maintaining the operability of circuit 10.

When the last transistor, $Q_4$, is "switched on", the audio signal at the speaker becomes its loudest (original unmodified output). This means that the $Q_D$ output (pin 10) of IC2 has become 5 V, which drives this transistor. This $Q_D$ output is also the singular input to a second NAND gate N2 on IC3 at both pins 1 and 2 of IC3. The output of gate N2 at pin 3 of IC3 now becomes $\phi$V. This is the second input (pin 4) to the first NAND gate N1 on IC3. The result is that the output at pin 6 of the first NAND gate N1 of IC3 remains at 5 V for the duration of the alarm cycle. This causes the IC2 shift register to stop shifting. Thus, the alarm signal remains at its full volume until SW1 is pushed. SW1 is a reset switch which, when pushed for at least one second, will start the sequence over again. The circuit may be reset in mid cycle or reset for the next time the alarm sounds off if SW1 is pushed at the end of a given alarm cycle.

The following full logic function tables show the inputs and outputs of the integrated circuits used in the present invention.

TABLE 1

FULL LOGIC FUNCTION TABLE FOR IC1 AND IC3

| (IC1) | | (IC3) | | |
|---|---|---|---|---|
| INPUTS | OUTPUTS | INPUTS | | OUTPUTS |
| N/A | $Y_X$ | $A_X$ | $B_X$ | $Y_X$ |
| | H L H L H L . . . | H | H | L |
| | | H | L | H |
| | | L | H | H |
| | | L | L | H |

There are no logic inputs to IC1, per se. Once biasing is established, the circuit oscillates.
H = high (5V) level (steady state), L = low (OV) level (steady state)
$A_X$ = the input at a given pin of any of the four NAND gates where x is a particular gate
$B_X$ = the other input to the gate x
$Y_X$ = the output of the gate x
IMPORTANT! crosstalk can occur in IC1 when both VCOs are operated simultaneously

TABLE 2

FULL LOGIC FUNCTION TABLE FOR IC2 (IC2)

| INPUTS | | | | | | | | | | | |
|---|---|---|---|---|---|---|---|---|---|---|---|
| MODE | CLOCKS | | | PARALLEL | | | | OUTPUTS | | | |
| CONTROLS | 2(L) | 1(R) | SERIAL | A | B | C | D | $Q_A$ | $Q_B$ | $Q_C$ | $Q_D$ |
| H | H | X | X | X | X | X | X | $Q_{AO}$ | $Q_{BO}$ | $Q_{CO}$ | $Q_{DO}$ |
| * H | ↓ | X | X | a | b | c | d | a | b | c | d |
| H | ↓ | X | X | $Q_B^{\tau}$ | $Q_C^{\tau}$ | $Q_D^{\tau}$ | d | $Q_{Bn}$ | $Q_{Cn}$ | $Q_{Dn}$ | d |
| L | L | H | X | X | X | X | X | $Q_{AO}$ | $Q_{BO}$ | $Q_{CO}$ | $Q_{DO}$ |
| L | X | ↓ | H | X | X | X | X | H | $Q_{An}$ | $Q_{Bn}$ | $Q_{Cn}$ |
| * L | X | ↓ | L | X | X | X | X | L | $Q_{An}$ | $Q_{Bn}$ | $Q_{Cn}$ |
| ↑ | L | L | X | X | X | X | X | $Q_{AO}$ | $Q_{BO}$ | $Q_{CO}$ | $Q_{DO}$ |
| ↓ | L | L | X | X | X | X | X | $Q_{AO}$ | $Q_{BO}$ | $Q_{CO}$ | $Q_{DO}$ |
| ↓ | L | H | X | X | X | X | X | $Q_{AO}$ | $Q_{BO}$ | $Q_{CO}$ | $Q_{DO}$ |
| ↑ | H | L | X | X | X | X | X | $Q_{AO}$ | $Q_{BO}$ | $Q_{CO}$ | $Q_{DO}$ |
| ↑ | H | H | X | X | X | X | X | $Q_{AO}$ | $Q_{B0}$ | $Q_{CO}$ | $Q_{DO}$ |

τShifting left requires external connection of $Q_B$ to A, $Q_C$ to B, and $Q_D$ to C.
Serial data is entered at input D.
H = high (5 V) level (steady state), L = low (0 V) level (steady state), X = irrelevant (any input from 0 to 5 V including transitions)
↓ = transition from high to low level,
↑ = transition from low to high level.
a, b, c, d = the level of steady-state input at inputs A, B, C, D, respectively.
$Q_{AO}$, $Q_{BO}$, $Q_{CO}$, $Q_{DO}$ = the level of $Q_A$, $Q_B$, $Q_C$, or $Q_D$, respectively, before the indicated steady-state input conditions were established.
$Q_{An}$, $Q_{Bn}$, $Q_{Cn}$, $Q_{Dn}$ = the level of $Q_A$, $Q_B$, $Q_C$, $Q_D$, respectively, before the most recent ↓ transition of the clock.
*lines in the table represent the reset and normal operation conditions of the circuit, respectively.

Figure 2A:
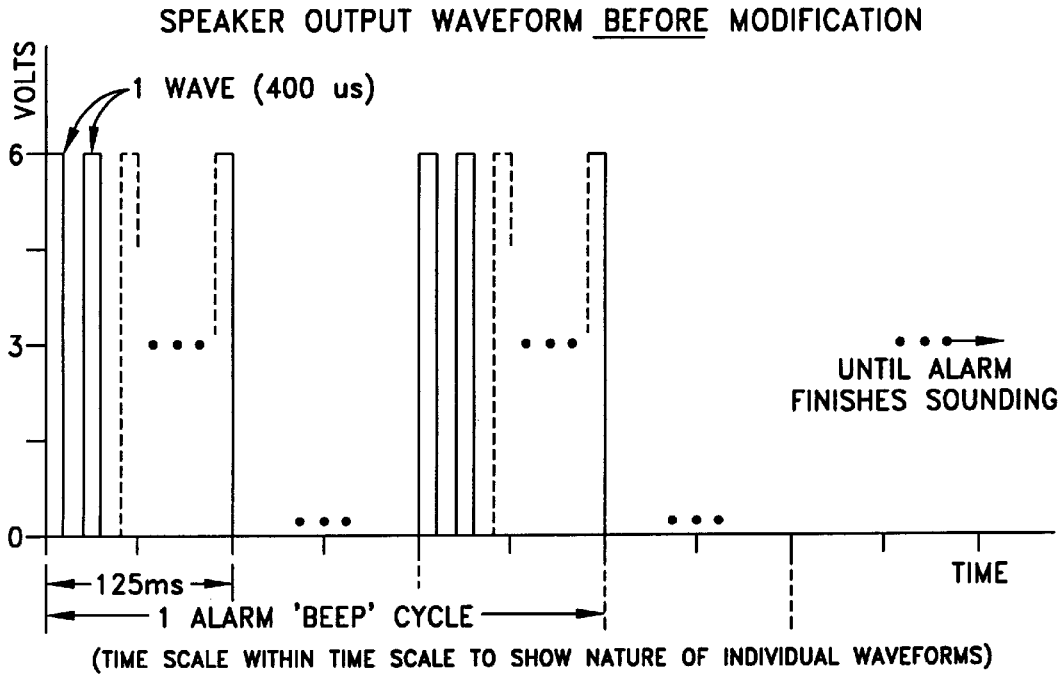
FIG. 2A (PRIOR ART)
FIG. 2A is a graph of speaker output wave form of a prior art audio alarm signal.
Figure 2B:
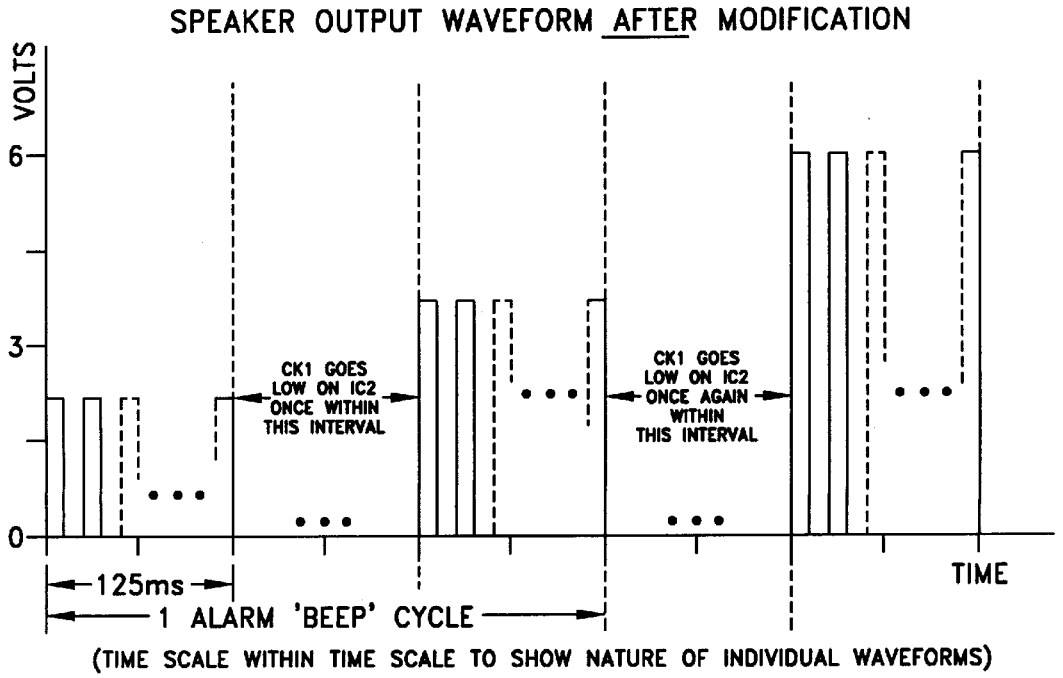
FIG. 2B is a graph of speaker output wave form for an audio alarm device initiated using the disclosed audio alarm signal initiation device.

The original prior art speaker output wave form is shown in FIG. 2A. The modified output wave form is shown in FIG. 2B.

The entire circuit shown in FIG. 1 can be added to any existing circuitry by putting all components on a modified board into an existing fire alarm housing using the appropriate insulating material, such as heat shrink tubing.

One specific application of this device can be for residential use in housing for the elderly where sudden loud noises can be undesirable. Another application is in hospitals or workplaces where intense concentration interrupted by sudden loud noises could have detrimental effects.

Of course, alternative embodiments of the disclosed device are contemplated by the invention. For example, one alternative design, which encompasses all of the above mentioned functions, may include many more than four drive transistors ($Q_1$–$Q_4$) and more than a single 4-bit parallel-access shift register so that the alarm signal seems to continuously increase in volume rather than increase in discrete increments. Furthermore, it may be desirable to have an audio increasing interval longer than 25 seconds for some applications, which would require the use of different integrated circuits.

In light of the above, it is therefore understood that within the scope of the appended claims, the invention may be practiced otherwise than as specifically described.

What is claimed is:

1. An audio alarm initiation device having a circuit configured to progressively increase a volume of an audio alarm signal upon the initiation of said alarm signal, the circuit comprising:

a multiple voltage-controlled oscillator generating at least two substantially identical duty cycle square waves;

at least two dual-input positive-NAND gates, a first of said at least two NAND gates responsive to said square waves and providing at least one output in response to said square waves;

a shift register sequentially providing switch signals in response to said at least one output;

a plurality of transistors sequentially responsive to said switch signals;

a plurality of resistors, the plurality of transistors electrically and sequentially connecting the plurality of resistors into said circuit in response to said switch signals; and an alarm signal speaker, the connection of said resistors sequentially increasing the volume of the alarm signal output through the speaker over a period of time.

2. The audio alarm initiation device as claimed in claim 1 wherein said multiple voltage-controlled oscillator comprises a medium-scale integration (MSI) integrated circuit dual voltage-controlled oscillator, the dual voltage-controlled oscillator generating first and second duty cycle square waves as first and second outputs of said oscillator.

3. The audio alarm initiation device as claimed in claim 2 wherein said first output is generated when said alarm signal is to be sounded.

4. The audio alarm initiation device as claimed in claim 3 further comprising a plurality of capacitors electrically connected to said oscillator to determine a frequency of the oscillator output signals.

5. The audio alarm initiation device as claimed in claim 3 wherein said first output of said oscillator is provided as a first input to a first of said dual-input positive-NAND gates.

6. The audio alarm initiation device as claimed in claim 5 wherein the at least one output of the first NAND gate controls the clocking of said shift register.

7. The audio alarm initiation device as claimed in claim 6 wherein said shift register switch signals sequentially switch on said plurality of transistors.

8. The audio alarm initiation device as claimed in claim 7 wherein a final output of said shift register is provided as an input to a second of said NAND gates, the output of which is a second input to said first NAND gate, which causes the output of said first NAND gate to remain constant for the duration of an alarm cycle.

9. An alarm signal initiation method, which sequentially and progressively increases a volume of an initiated audio alarm signal through an alarm speaker, said method comprising:

receiving outputs from a shift register;

sequentially switching on one of a plurality of transistors in response to receiving outputs from said shift register; and sequentially including one of a plurality of resistors into an alarm circuit to vary the volume of the alarm signal emanating from said alarm speaker in response to sequentially switching on one of said plurality of transistors.

10. The method claimed in claim 9 further comprising shifting said outputs from said shift register in response to a clock control output of a first NAND gate received by said shift register.

11. The method claimed in claim 10 further comprising:

providing a final output of the shift register as an input to a second NAND gate;

providing a gate output of said second NAND gate as a gate input to said first NAND gate to cause the clock control output of the first NAND gate to remain constant; and maintaining the volume of said alarm signal at a highest level when said clock control output remains constant.

* * * * *